United States Patent [19]

Morse

[11] 4,262,603

[45] Apr. 21, 1981

[54] DOOR LOCKING ARRANGEMENT FOR RAILWAY HOPPER CAR

[75] Inventor: George W. Morse, Westville, Ind.

[73] Assignee: Pullman Incorporated, Chicago, Ill.

[21] Appl. No.: 955,057

[22] Filed: Oct. 26, 1978

[51] Int. Cl.[3] ..... E05C 3/16; B61D 7/02

[52] U.S. Cl. ..... 105/310; 292/78; 292/237; 105/250

[58] Field of Search ..... 292/216, 179, 106, 207, 292/78, 79, 237; 105/250, 251, 252, 310

[56] References Cited

U.S. PATENT DOCUMENTS

| | | | |
|---|---|---|---|
| 1,027,325 | 5/1912 | Ducsay | 292/207 X |
| 1,195,582 | 8/1916 | Hart | 105/310 |
| 1,375,700 | 4/1921 | Ingoldsby | 105/310 |
| 2,575,465 | 11/1951 | Patton | 292/78 |
| 2,849,250 | 8/1958 | Williamson | 292/216 X |
| 4,138,948 | 2/1979 | Korolis | 105/251 |

*Primary Examiner*—Richard E. Moore

*Attorney, Agent, or Firm*—Stephen D. Geimer; Richard J. Myers

[57] ABSTRACT

A door locking arrangement for a railway car hopper includes a latch element and keeper assembly having camming surfaces which during gravitational opening of the door lift the latch element to a disengaged position. The locking is controlled by a longitudinal actuating bar which controls the latch element. A spring biasing device urges the latch element to its locked position.

8 Claims, 5 Drawing Figures

DOOR LOCKING ARRANGEMENT FOR RAILWAY HOPPER CAR

BACKGROUND OF THE INVENTION

1. Field of the Invention

The present invention relates to railway hopper cars and more specifically to a car having lower side discharge openings and doors which are movable by gravitational forces to an open position.

2. Description of the Prior Art

The dump car construction shown in U.S. Pat. No. 1,357,700, issued Apr. 26, 1921, discloses a railway car having bottom discharge openings which open downwardly for discharging material from the car. A longitudinally extending actuating bar mounted on rollers includes cam latch devices which move with the bar and which interengage camming surfaces on keepers for retaining the doors in the closed position. Thus the doors are wedged in the closed position by the cam latches which are supported on the movable, longitudinal bar. The present invention is an improvement over this patented construction in that the latch element is a separate pivoted element which is actuated by the longitudinal bar to move between open and closed positions. The latch element of the present arrangement includes camming faces which are separate from the longitudinal actuating rod and the latch is spring-actuated to a closed position.

This arrangement is an improvement over the aforementioned patent.

SUMMARY OF THE INVENTION

The hopper door locking arrangement of the present invention controls the locking of a pair of hopper doors which move in hinged fashion outwardly whereby materials within the hoppers are discharged downwardly on slope sheets to opposite sides of the car. The locking mechanisms each comprise a latch member pivotally connected behind the hopper structure and having a camming nose portion which in the closed position engages and complements a camming surface provided on a keeper bar connected to the lower ends of a door. In the locked position, a longitudinal bar restrains the latch element against pivotal movement to an open position. The bar has a slot through which the body of the latch member extends, the slot having a relatively narrow portion which in the closed position restrains movement of the latch member. Upon sliding movement of the actuating bar the body of the latch member is positioned within a relatively wide portion of the slot, which thereupon permits the latch member to be cammed upwardly to a disengaged position by the weight of the materials which are to be discharged from the hopper. As the materials are discharged a spring device repositions the latch member in a locking position and as the door is again moved inwardly to a closed position by a suitable track-side closing device the door-mounted keeper element, which also has camming surfaces, engages the latch element and again moves the parts into relative locking arrangement.

DESCRIPTION OF THE PREFERRED EMBODIMENT

Figure 1:
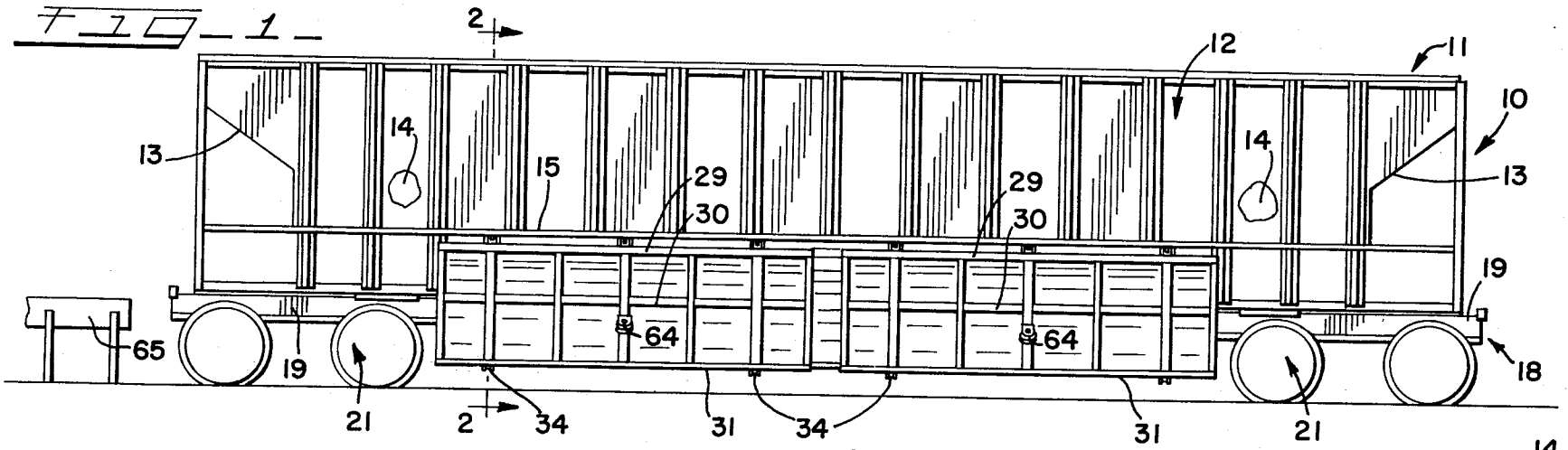
FIG. 1 is a side elevational view of a railway hopper car having longitudinally spaced pairs of discharge doors.
Figure 2:
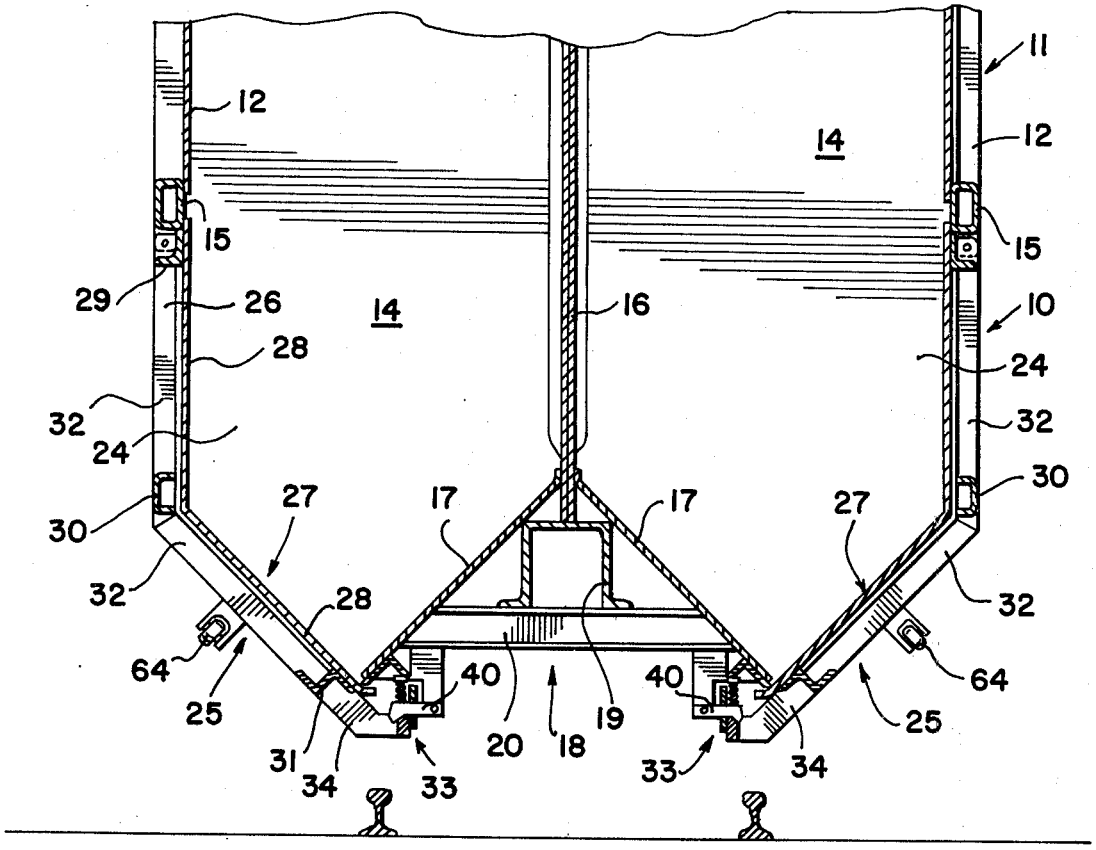
FIG. 2 is a cross-sectional view taken substantially along the line of 2—2 of FIG. 1.

A railway hopper car 10, as shown in FIGS. 1 and 2 includes a car body generally designated at 11 having side walls 12 and end walls 13. The railway hopper car 10 comprises a plurality of hopper structures 14 disposed within opposite side sill structures 15 and separated by means of a central vertical divider sheet 16. In the present car four hoppers are provided. Each of the hopper structures 14 include downwardly and outwardly extending slope sheets 17 suitably supported on an under frame structure 18. The under frame structure 18 comprises a center sill 19 including a plurality of transfer supports 20 to which are connected the slope sheet 17. The under frame structure 18 is supported on car trucks 21.

Figure 4:
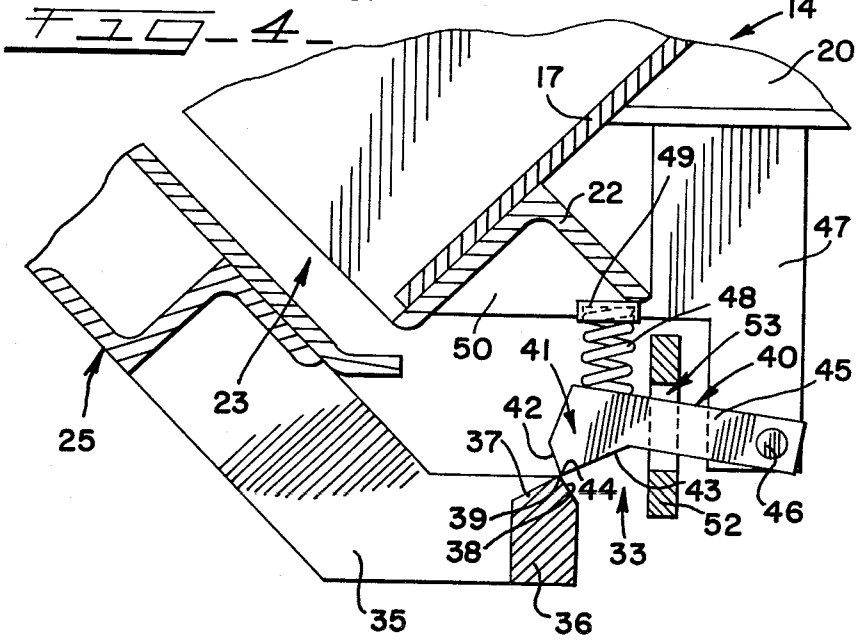
FIG. 4 is a view similar to FIG. 3 showing the unlocking position of a door locking arrangement.
Figure 3:
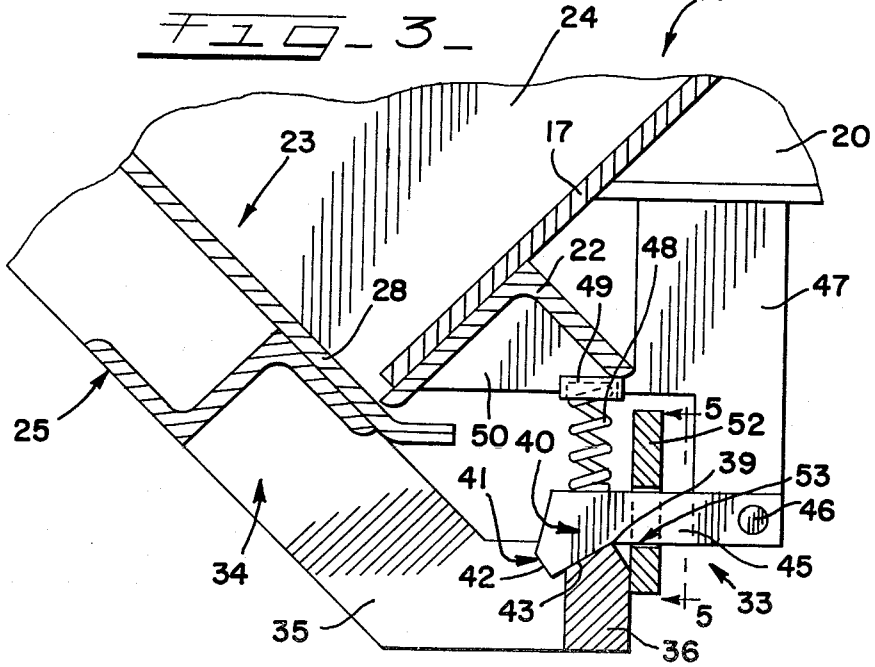
FIG. 3 is an enlarged cross-sectional view of one of the door locking arrangements disclosed in FIG. 2 with the same in a closed position.

As shown in FIGS. 3 and 4, the hopper structure 14 includes reinforcing angles 22 which extend longitudinally and are connected to the lower ends of the slope sheets 17 adjacent to hopper discharge openings 23. The ends of the hoppers each includes vertical end sheets 24. Each of the hoppers is adapted to be closed by means of doors 25 which are hingedly connected to the sides of the car. Each door 25 includes a vertical section 26 and an integral incline section 27. A sheet panel 28 provides for the inner supporting surfaces of the door and is reinforced by longitudinal support stringers 29, 30 and 31. Vertical supports 32 connected to the stringers 29, 30 and 31 at longitudinally spaced intervals further reinforce the door structures.

A door locking arrangement is designated for each of the hoppers by the reference character 33. As best shown in FIGS. 3 and 4, each door locking arrangement 33 comprises a keeper means 34 consisting of a pair of spaced plates 35 which are connected at their upper ends to the stringers 25 and which project downwardly and inwardly with respect thereto. The spaced plates 35 support at their lower ends a transversely extending keeper bar 36 having inclined cam surfaces 37 and 38 leading to an apex 39.

The locking arrangement 33 also includes a latch member 40 having a nose portion 41 provided with incline cam surfaces 42 and 43 extending in v-shaped fashion to an apex 44. The latch member 40 also includes a body 45 having at one end a pivot 46 pivotally connecting the latch member to a vertical support bracket 47 which is suitably connected to one of the transverse supports 20. The latch member 40 is normally pivoted to the locked position shown in FIG. 3 by means of a biasing spring 48 suitably retained in a spring holder 49 which is suitably connected to a plate 50 on one of the angles 22.

Figure 5:
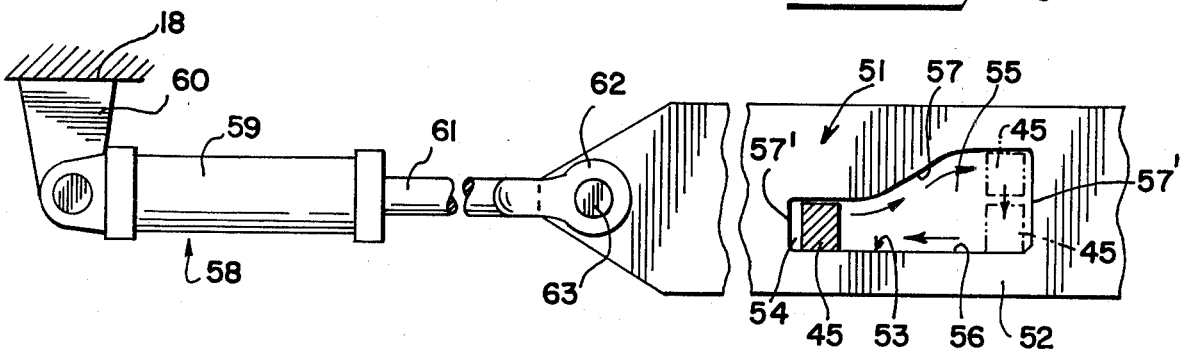
FIG. 5 is a cross-sectional view disclosing portions of a longitudinal locking arrangement taken substantially along the line 5—5 of FIG. 3.

Operation of the latch member 40 is controlled by means of a longitudinally actuated or sliding bar 51 which is suitably connected to the under frame for relative guided and sliding movement. The actuating bar 51 comprises a vertical plate 52 having a transversely extending slot 53. As best shown in FIG. 5, the slot 53 is provided with a relatively narrow portion 54 and relatively connected wider portion 55. The slot 53 is formed by lower straight horizontal surface 56 and an upper curved horizontal surface 57. Vertical surfaces 57' connect the surfaces 56 and 57. As also best shown in FIG. 5 a fluid extensible device 58 comprises a fluid cylinder 59 suitably supported on a bracket 60, in turn connected to the under frame structure 18. The fluid extensible device 58 includes a piston rod 61 provided with an eye 62 at one end thereof and is pivotally connected as indicated at 63 to the bar 51.

As best shown in FIGS. 1 and 2 the doors 25 are provided with rollers 64 on the outer surfaces thereof which are adapted to engage closing cams 65 which are mounted on the side of the railway track on which the railway car is supported.

THE OPERATION

FIGS. 2 and 3 show the doors in a locked position wherein the latch member 40 is in locking engagement relative to the keeper means 34 of each of the doors. Vertical swinging movement of the latch member cannot occur in the present position of the longitudinal actuating bar 51 since the body 45 of the latch member, as shown in FIG. 5, is in the narrow portion of the slot 53 providing stop means whereby the doors are retained in the closed position. Assuming now that the fluid extensible device 58 shown in FIG. 5 is actuated to move the piston rod 61 to the left, the bar 51 is moved so that the body 45 of the latch element is within the wide slot portion 55, shown in phantom in FIG. 5. In this disengaged position of the locking bar 51, the door 25 now moves outwardly by gravity and the camming surfaces 37 and 43 are in sliding engagement whereupon the latch element 40 is cammed upwardly to the position shown in FIG. 4 and the door is released from its closed position. As the apexes 39 and 44 clear from the position shown in FIG. 4 and the door is opened the spring 48 pushes the latch element downwardly into the position shown in FIG. 3 whereupon it may again be engaged into locking position upon closing of the door. During this position the longitudinal actuating bar 51 remains in the same position.

After the load has been discharged the doors are moved inwardly as the cars travels along the track by the engagement of rollers 64 with the track-side closing device 65 which swings the doors inwardly and whereupon the doors become secured in the closed position by means of the springs 48 which force the latch elements 40 to the position shown in FIG. 3. The doors are so retained in this position since the spring 48 is sufficiently strong to maintain this position and there being no weight of materials within the hopper. To lock the doors in this position, the fluid extensible device 58 effects to move the longitudinal bar to the position shown in FIG. 5 whereby the body 45 is within the narrow portion of the slot 53 and is prevented from vertical movement. Thus, the door is again firmly locked in position while the railway car returns to its loading sight.

What is claimed is:

1. In a railway hopper car having a hopper structure including a downwardly and outwardly extending slope sheet and a discharge opening, and a door hingedly connected to said structure for movement relative to said opening between open and closed positions, the improvement of a locking mechanism for said door comprising:

keeper means connected to said door, a latch member, means movably connecting said latch member to said hopper structure, said latch member having a lower camming surface, said keeper means including an upper camming surface adapted to engage said lower camming surface in the closed position of said door, a locking bar movably supported on said car, said locking bar having a stop means in a lock position engaging said latch to lock the same against movement, said locking bar being movable to an opening position wherein said stop means is displaced from said latch and the door is free to move by gravity thereby camming said latch member to a disengaged position relative to said keeper means, and biasing means supported on said hopper structure and urging said latch member to its locked position, said biasing means being operative during periods when the hopper structure is empty in cooperation with said upper camming surface to hold said door in its closed position while said locking bar is in said opening position.

2. The invention in accordance with claim 1, said latch member being pivotedly connected to said hopper structure.

3. The invention in accordance with claim 1, said camming surfaces being inclined and complementary.

4. The invention in accordance with claim 3, said latch member having a nose portion including a second camming surface extending upwardly and outwardly relative to said lower camming surface of said latch member, in v-shaped configuration, and a third camming surface on said keeper means.

5. The invention in accordance with claim 4, said third camming surface on said keeper means sloping downwardly and outwardly in inverted v-shaped configuration.

6. The invention in accordance with claim 1, said locking bar having vertical sides and a transverse longitudinal slot extending therethrough providing said stop means.

7. The invention in accordance with claim 6, said latch member having a body portion extending transversely through said slot, a nose portion on said body portion disposed outwardly of said slot and including said camming surface, and means pivotedly connecting said body portion to said hopper structure inwardly of said locking bar.

8. The invention in accordance with claim 7 said slot having a narrow portion and a relatively wider portion communicating therewith, said narrow portion in a lock position of said bar restraining said latch member against pivotal movement to an open position, and means for moving said locking bar to an unlocking position wherein said latch member is disposed in said wider portion and said latch member is moved by gravitational opening of said door to said unlocked position.

* * * * *